US008023858B2

(12) United States Patent
Shinoda

(10) Patent No.: US 8,023,858 B2
(45) Date of Patent: Sep. 20, 2011

(54) MATERIAL SUPPLYING CONTAINER HAVING SEALING MEMBER, AND IMAGE FORMING UNIT INCLUDING SAME

(75) Inventor: Keisuke Shinoda, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 848 days.

(21) Appl. No.: 11/595,862

(22) Filed: Nov. 13, 2006

(65) Prior Publication Data

US 2007/0258727 A1 Nov. 8, 2007

(30) Foreign Application Priority Data

May 2, 2006 (JP) ..... 2006-128486

(51) Int. Cl.
*G03G 15/08* (2006.01)

(52) U.S. Cl. ..... 399/106; 399/258; 399/259

(58) Field of Classification Search ..... 399/102, 399/103, 105, 106, 258, 259; 222/145.3, 222/484, 485
See application file for complete search history.

(56) References Cited

U.S. PATENT DOCUMENTS

| | | | | |
|---|---|---|---|---|
| 4,607,938 | A * | 8/1986 | Hosoi et al. | 399/259 |
| 4,615,608 | A * | 10/1986 | Mizutani | 399/103 |
| 4,993,595 | A * | 2/1991 | Bertram et al. | 222/129 |
| 5,392,947 | A * | 2/1995 | Gentile | 222/129 |
| 5,598,254 | A * | 1/1997 | Ikesue et al. | 222/DIG. 1 |
| 6,188,855 | B1 | 2/2001 | Fujioka | |
| 6,687,474 | B2 * | 2/2004 | Yamada et al. | 399/106 |
| 6,880,924 | B2 * | 4/2005 | Sesek et al. | |
| 2001/0043826 | A1 | 11/2001 | Mizoguchi et al. | |
| 2003/0173364 | A1 * | 9/2003 | Eva et al. | 222/485 |
| 2005/0077316 | A1 | 4/2005 | Roberts | |
| 2005/0249519 | A1 * | 11/2005 | Chadez | 399/106 |
| 2006/0083540 | A1 | 4/2006 | Kadowaki et al. | |

FOREIGN PATENT DOCUMENTS

| | | | |
|---|---|---|---|
| JP | 05-188667 | A | 7/1993 |
| JP | 05-289502 | A | 11/1993 |
| JP | 08-202239 | A | 8/1996 |
| JP | 11-231757 | A | 8/1999 |
| JP | 2000-187379 | A | 7/2000 |
| JP | 2001-331027 | A | 11/2001 |
| JP | 2003-173076 | A | 6/2003 |
| JP | 2003-195614 | A | 7/2003 |

OTHER PUBLICATIONS

Chinese Office Action dated Dec. 26, 2008, in Appln. No. 200710079285.2.
Australian Office Action dated Sep. 12, 2008.
Japanese Office Action issued in corresponding Japanese Application No. 2006-128486 on Apr. 21, 2011.

* cited by examiner

*Primary Examiner* — David M Gray
*Assistant Examiner* — Laura K Roth
(74) *Attorney, Agent, or Firm* — Sughrue Mion, PLLC

(57) ABSTRACT

A material supplying container and an image forming apparatus are provided. The material supplying container includes two or more containers each of which contains a material; supply openings respectively formed in and corresponding to the containers; and seal members that respectively close the supply openings, wherein the supply openings can be opened by simultaneously operating the seal members.

8 Claims, 12 Drawing Sheets

MATERIAL SUPPLYING CONTAINER HAVING SEALING MEMBER, AND IMAGE FORMING UNIT INCLUDING SAME

BACKGROUND (i) Technical Field

The present invention relates to a material supplying container which is used in an image forming apparatus such as a copying machine, a printer, a facsimile, a complex machine of these factors, etc. which forms an image on a recording medium such as recording paper, employing electro photographic system.

(ii) Related Art

The image forming apparatus employing the electro photographic system such as a copying machine and a printer is so constructed that an electrostatic latent image formed on a photoconductive drum, for example, is developed with a developer (toner) by a developing device to form a toner image, and this toner image is transferred to a recording medium such as recording paper to be fixed thereon.

Developing system in the developing device to be employed in the image forming apparatus of the above described type includes one-component developing system in which magnetic toner is used, and two-component developing system in which two-component developer containing toner and magnetic carrier mixed is used. Recently, particularly in a color image forming apparatus, the two-component developing system in which color toner not containing magnetic particles is used is a mainstream.

In whichever developing device of the one-component developing system or the two-component developing system, it is necessary to provide a structure for replenishing the toner which will be consumed along with formation of images.

Generally, replenishment of the toner is performed by using a developer container (a toner cartridge) which is detachably mounted on the developing device.

The toner cartridge is provided with an opening for supplying the toner to the developing device. The opening is closed by a seal member to contain the toner in the toner cartridge.

The seal member which closes the opening is so constructed that the opening can be opened by operation from the exterior, after the toner cartridge has been mounted on the developing device. In this manner, the toner can be prevented from scattering, when it is supplied to the developing device.

As the seal member for this purpose, use of a seal tape is known. In a structure where the seal tape is used, the seal tape is bonded to the toner cartridge so as to cover the opening, and folded back at one end of the opening in a longitudinal direction to be returned to the other end side, so that a distal end of the seal tape is projected outward. Accordingly, by pulling the tip end which is projected outward, the seal tape will be removed from a depth in the toner cartridge, whereby the opening can be opened.

As the seal tape, a so-called heat seal is used in many cases. The heat seal is made of a resin tape as a substrate having a fusible layer which will be fused by heat formed on its one face, and when the fusible layer is heated and pressurized with a hot plate or the like, the fusible layer will be fused and bonded to an objective position (the opening).

Moreover, as another system for replenishing the toner, there has been known an image forming apparatus which is so constructed that an image forming unit (a so-called process cartridge) in which a developing device having a toner storage container and a photoconductive drum are integrally incorporated can be exchanged as a whole. The image forming unit is detachably mounted on a main body of the image forming apparatus. Generally, in the image forming unit, components of other mechanisms related to electro photographic process to be disposed around the photoconductive drum are also integrally incorporated.

Even in the image forming unit as described above, a toner containing room which contains the toner is shut from the developing device by the seal member so that the toner can be prevented from leaking outside through the developing device during transportation or so. As the seal member, the structure using the above described seal tape is employed in many cases, so that opening operation can be done from outside of the image forming unit. In order to exchange the image forming unit, a new image forming unit with its seal member removed will be mounted on the main body of the image forming apparatus. Because the seal member isolates the toner containing room from the developing device in the image forming unit, the toner will not be scattered immediately, when the seal member is removed to do the mounting work.

SUMMARY

According to the invention, there is provided a material supplying container comprising: a plurality of containers each of which contains a material; a plurality of supply openings respectively formed correspondingly to said plurality of containers; and a plurality of seal members that respectively close said supply openings, wherein said plurality of supply openings can be opened by simultaneously operating said plurality of seal members.

BRIEF DESCRIPTION OF THE DRAWINGS

Exemplary embodiments of the present invention will be described in detail based on the following figure, wherein.

DETAILED DESCRIPTION

Now, an exemplary embodiment of the invention will be described in detail, referring to the attached drawings.

Figure 1:
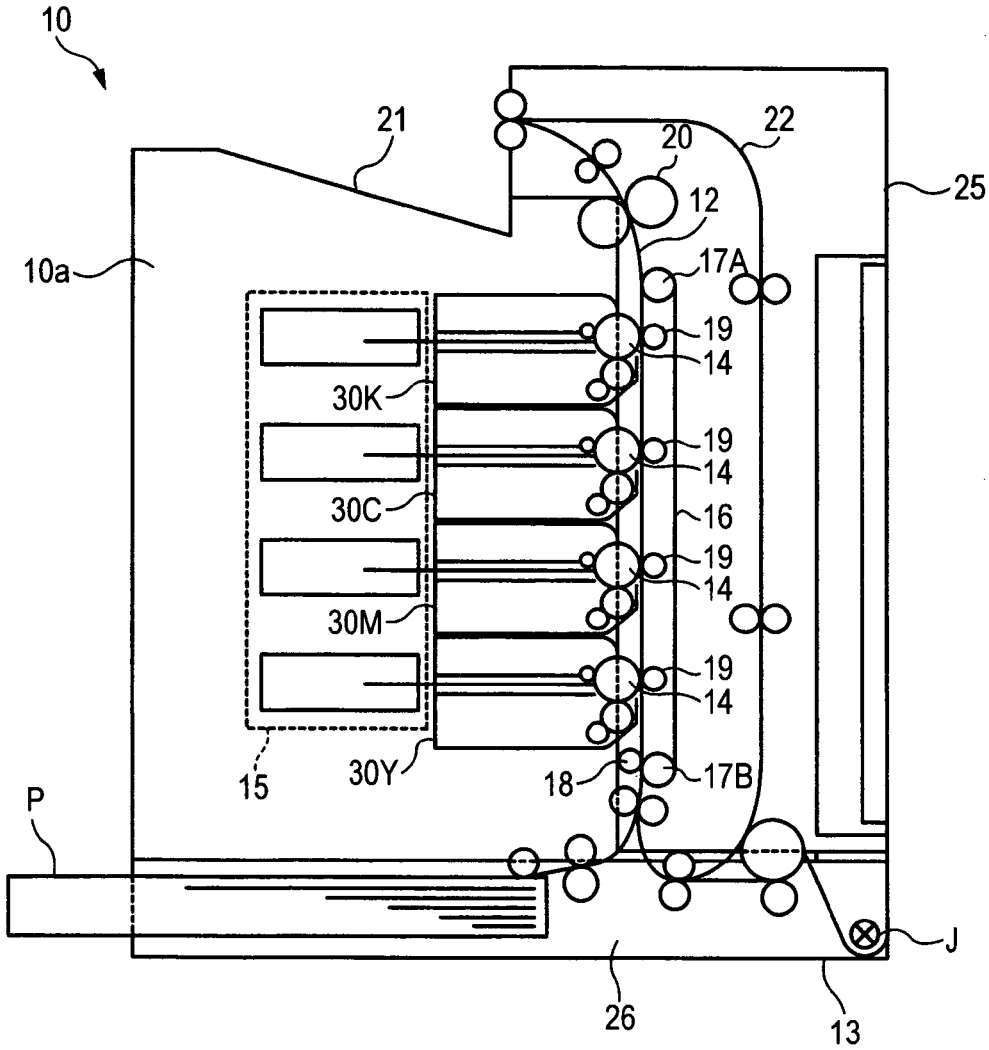
FIG. 1 is a schematic structural view showing an image forming apparatus according to an exemplary embodiment of the invention.
Figure 2:
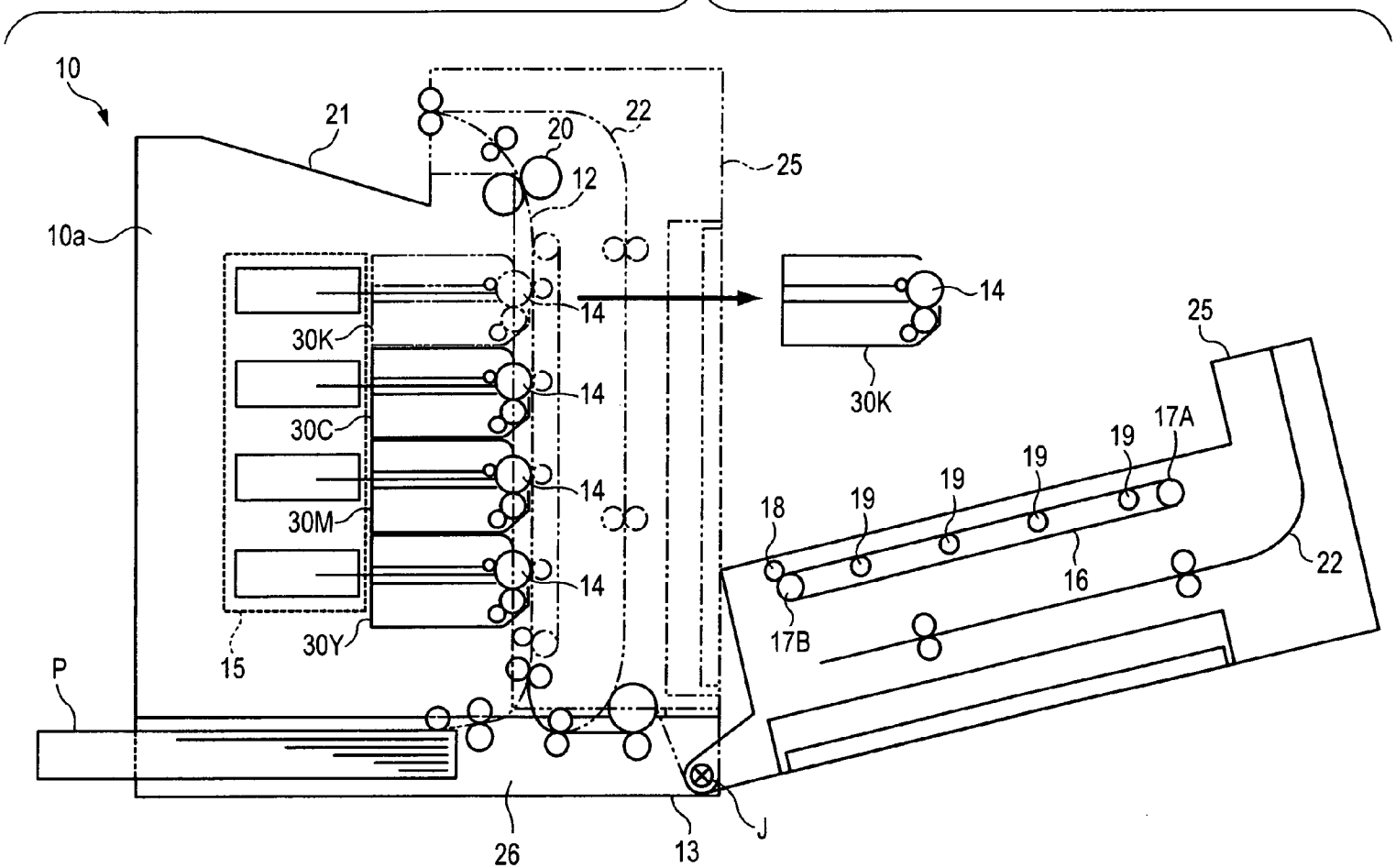
FIG. 2 is a schematic structural view showing the image forming apparatus in a state where a front cover is opened.

FIG. 1 is a schematic structural view showing an image forming apparatus according to the exemplary embodiment, and FIG. 2 is a schematic structural view showing the image forming apparatus in a state where a front cover thereof is opened.

An image forming apparatus 10 as shown in FIG. 1 is of a so-called tandem type in which process cartridges 30 (30Y, 30M, 30C and 30K) of four colors are vertically arranged in a main body 10*a*. A conveying path 12 for conveying recording paper P to respective positions corresponding to the process cartridges 30 substantially vertically from below to above is arranged. Further below (at an upstream side) the process cartridge 30Y in the lowermost stage (the most upstream), there is provided a paper supply cassette 13 for storing sheets of the recording paper P which are conveyed along the conveying path 12 so that toner images may be sequentially transferred thereon.

The process cartridges 30 (30Y, 30M, 30C and 30K) are successively arranged in order of the process cartridge 30Y which forms a toner image of yellow (Y), the process cartridge 30M which forms a toner image of magenta (M), the process cartridge 30C which forms a toner image of cyan (C), and the process cartridge 30K which forms a toner image of black (K), from an upstream side (a lower side in the drawings) of the conveying path 12. These process cartridges 30 have substantially the same structure except the color of the toner, and will be described hereunder as "the process cartridge 30", unless they need to be described separately. The process cartridge 30 integrally incorporates a photoconductive drum (an image holding body) 14, and various devices for electrophotographic process which are successively arranged around the photoconductive drum 14, into a cartridge. When the toner contained therein has been consumed, the whole process cartridge 30 will be exchanged for a new one. This process cartridge 30 in this exemplary embodiment corresponds to a material supplying container and an image forming unit according to the invention, and its structure will be fully described below.

On the other side of the conveying path 12 interposing the process cartridges 30, there is provided an exposing device 15 which is common to all the process cartridges 30. This exposing device 15 will light on four semiconductor lasers which are not shown, according to image data corresponding to the four colors. Then, the lights from these four semiconductor lasers are subjected to polarity scanning by a polygon mirror which is not shown, and introduced to exposure points on the photoconductive drums 14 by way of an fθ lens and a plurality of reflective mirrors which are not shown, whereby optical images are formed on the photoconductive drums 14.

A conveying belt 16 which circularly moves along the conveying path 12 is arranged at positions corresponding to the photoconductive drums 14 of the respective process cartridges 30. This conveying belt 16 is formed of a belt material which can electrostatically suck the recording paper P, and stretched around a drive roller 17A and a driven roller 17B in a pair. Moreover, a suction roller 18 for enabling the conveying belt 16 to electrostatically suck the recording paper P is provided on the conveying path 12.

Transfer rollers 19 are respectively provided on a back face side of the conveying belt 16 corresponding to the photoconductive drums 14 of the respective process cartridges 30. These transfer rollers 19 are provided for the purpose of bringing the recording paper P on the conveying belt 16 into tight contact with the photoconductive drums 14 there by to transfer the toner images formed on the photoconductive drums 14 to the recording paper P.

A fixing device 20 is provided on the conveying path 12 further above the process cartridge 30K (at a downstream side) in the uppermost stage (the most downstream). A paper discharge part 21 for receiving the recording paper P which has been discharged with the toner image fixed thereon by the fixing device 20 is provided in an upper part of the main body 10*a* integrally therewith. The main body 10*a* is further provided with a reverse conveying path 22 for conveying the recording paper P whose one face has been fixed by the fixing device 20 again to the conveying path 12, after it has been reversed upside down.

The main body 10*a* of the image forming apparatus 10 is provided with a front cover 25 which can be rotated around a rotation journal J provided at its lower end, as shown in FIG. 2. This front cover 25 serves as an exterior cover in cooperation with the main body 10*a* in a closed state. Specifically, the front cover 25 constitutes a side wall part of the image forming apparatus 10 at a front side thereof, above the paper supply cassette 13.

The conveying belt 16, the drive roller 17A, the driven roller 17B, the suction roller 18, the transfer rollers 19 and the reverse conveying path 22 are attached to the front cover 25. Accordingly, when the front cover 25 is opened, these components will be separated from the main body 10*a* following the opening motion. In this manner, by opening the front cover 25, the process cartridges 30 will be exposed, and easy access of the user to the conveying path 12 can be obtained.

In this exemplary embodiment, the respective process cartridges 30 are detachably mounted on the main body 10*a* in a substantially horizontal direction, as exemplified by the process cartridge 30K in FIG. 2. Accordingly, by opening the front cover 25, it will be possible to conduct mounting and detaching operations of the process cartridges 30. In addition, set detection sensors which are not shown will detect conditions of the respective process cartridges 30 when they are set, and will output results of the detection to a control device which is not shown.

In this manner, the process cartridges 30 can be exposed and exchanged, by opening the front cover 25. Moreover, clogged paper can be removed (jam clear) in a state where the photoconductive drums 14 are exposed.

The image forming apparatus 10 having the above described structure will be operated as follows to conduct image forming process.

As a first step, image data will be inputted into the image forming apparatus 10 from an image reading device (a scanner) or a computer which is not shown. After a determined image process has been performed on the image data using an image processing device which is not shown, the data will be outputted to the exposing device 15, as the image data of the respective colors (Y M C K).

According to the inputted image data of the respective colors, the exposing device 15 will irradiate exposing beams which are emitted from the respective semiconductor lasers, to the photoconductive drums 14 of the process cartridges 30. In the respective process cartridges 30, the electrostatic latent images which have been formed by exposure on the photoconductive drums 14 will be developed with toners of the respective colors thereby to be formed into toner images.

Then, in the transfer parts which are in contact with the respective transfer rollers 19, the toner images formed on the respective photoconductive drums 14 of the process cartridges 30 will be successively superposed and transferred to a recording paper P which is supplied from a paper supply part 26 in the paper supply cassette 13 in a state sucked to the conveying belt 16 by an action of the suction roller 18.

The recording paper P to which the toner images have been electrostatically transferred will be conveyed to the fixing device 20, while the recording paper P is electrostatically sucked to the conveying belt 16. After the toner images have been fixed by fixing process with heat and pressure in the fixing device 20, the recording paper P will be discharged to the paper discharge part 21 which is provided in the upper part of the image forming apparatus 10. In this manner, a series of the image forming process will be completed.

Now, each of the process cartridges 30 will be described in detail.

Figure 3:
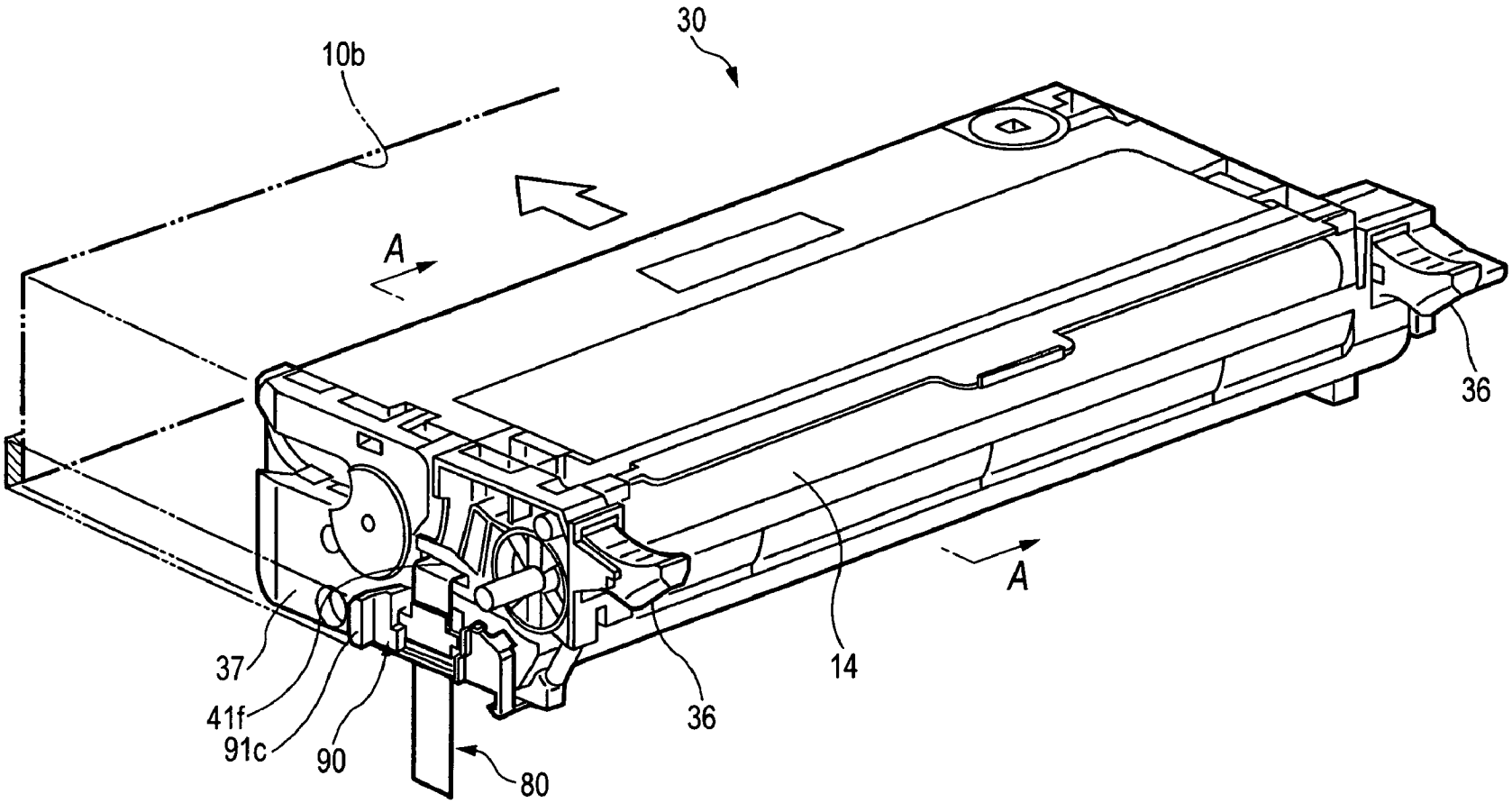
FIG. 3 is a perspective view showing an outer appearance of a process cartridge.
Figure 4:
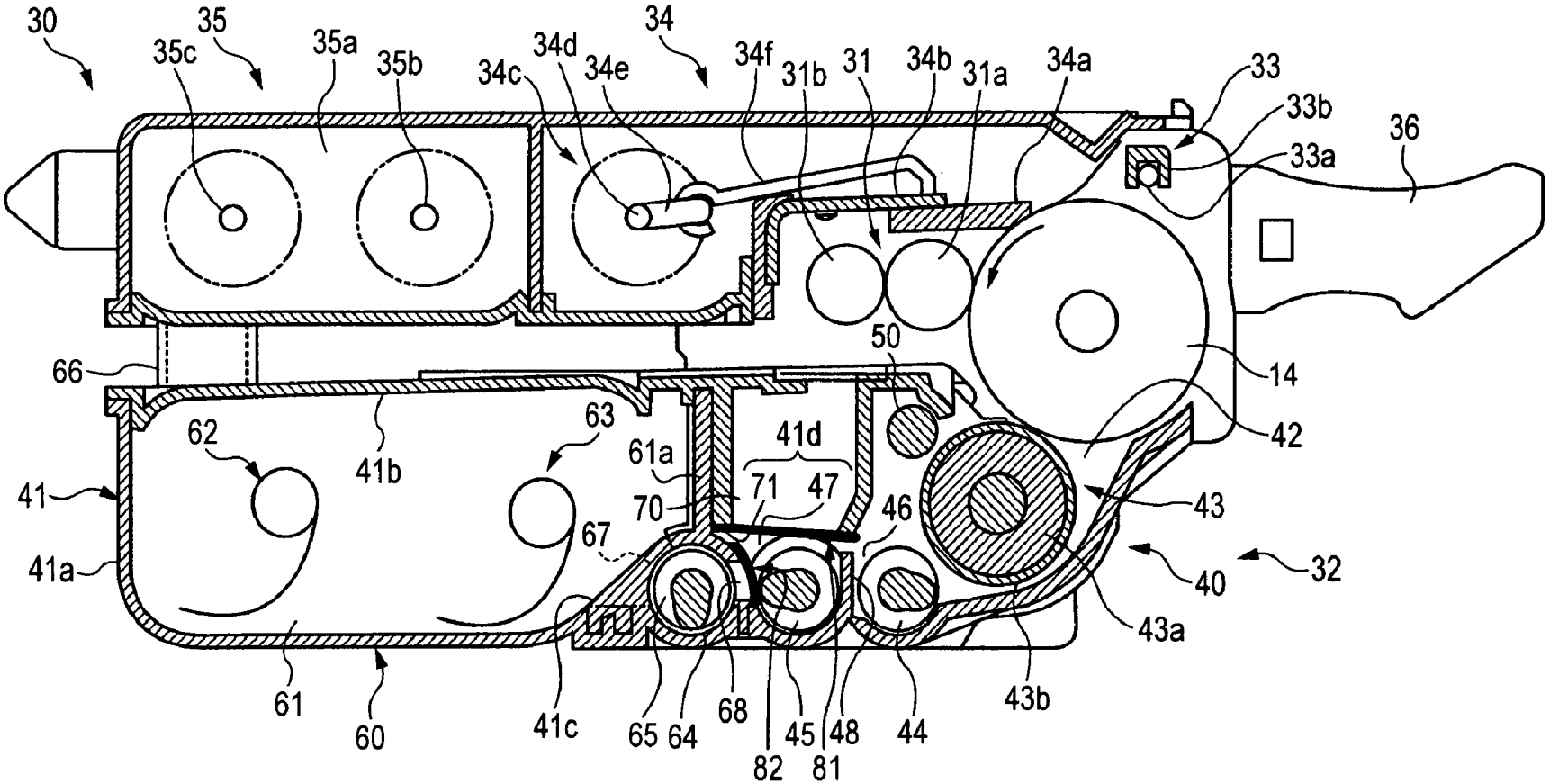
FIG. 4 is a sectional view taken along a line A-A in FIG. 3.

FIG. 3 is a perspective view showing an outer appearance of the process cartridge 30, and FIG. 4 is a sectional view of the same, taken along a line A-A in FIG. 3.

The process cartridge 30 in this exemplary embodiment has an outer shape of a flat rectangular parallelopiped, as shown in FIG. 3. The process cartridge 30 is generally divided in two, namely, an upper stage and a lower stage. A space for an optical path which the exposing beam from the exposing device 15 passes through is formed between the upper and lower stages.

The process cartridge 30 is provided with the photoconductive drum 14, an electrifying device 31, a developing device 32, a diselectrifying device 33, and a cleaning device 34. The process cartridge 30 is further provided with a sub toner replenishing unit 35 and a handle 36.

The cleaning device 34 and the sub toner replenishing unit 35 are mounted on the upper stage, while the developing device 32 is mounted on the lower stage. The photoconductive drum 14 and the electrifying device 31 are positioned between the upper and lower stages.

In the following description, an axial direction of the photoconductive drum 14 is referred to as a lateral direction, a horizontal direction perpendicular to the axial direction is referred to as a longitudinal direction, and a direction perpendicular to both the lateral direction and the longitudinal direction is referred to as a vertical direction.

The photoconductive drum 14 is rotatably mounted, and will be rotated by a drive motor, which is not shown, in a direction as shown by an arrow mark in FIG. 4. A photosensitive layer is formed on an outer peripheral face of the photoconductive drum 14, although not shown in the drawings. The electrifying device 31, the developing device 32, the diselectrifying device 33, and the cleaning device 34 are arranged around the photoconductive drum 14 along the direction of its rotation which is shown by the arrow mark in FIG. 4. Along with the rotation of the photoconductive drum 14, the electrifying device 31 will electrify the photosensitive layer on the peripheral face, and the developing device 32 will develop the electrostatic latent image which has been formed by the aforesaid exposing device 15 thereby to form the toner image. The diselectrifying device 33 will erase electrification history of the photosensitive layer, after the toner image has been transferred to the recording paper, and the cleaning device 34 will mechanically remove the toner which remains on the photosensitive layer.

Structures of the respective mechanisms in the process cartridge 30 will be described below.

The electrifying device 31 includes an electrifying roll 31*a* which is arranged in contact with the photoconductive drum 14, and an electrifying cleaner 31*b* which is arranged in contact with the electrifying roll 31*a*. The electrifying roll 31*a* is rotatably mounted, and will be rotated following the rotation of the photoconductive drum 14. An electrifying bias for electrifying the photoconductive drum 14 to a determined potential (negative in this exemplary embodiment) will be applied to the electrifying roll 31*a* from a power supply which is not shown. The electrifying cleaner 31*b* includes a roll member or a brush member or the like which can be rotated, and will be rotated following the rotation of the electrifying roll 31*a*. The electrifying cleaner 31*b* will remove foreign substances such as the toner which has been transferred from the photoconductive drum 14 and adhered to the electrifying roll 31*a*.

The diselectrifying device 33 includes a transparent rod member 33*a* extending in the axial direction of the photoconductive drum 14, a frame 33*b* which holds the rod member 33*a*, and an LED (not shown) which is opposed to an end face of the rod member 33*a* in the axial direction. The rod member 33*a* is formed of plastic, for example, and provided with a plurality of grooves on its outer peripheral face in the direction perpendicular to the axial direction.

The cleaning device 34 includes a cleaning blade 34*a*, a bracket 34*b*, and a toner recovering mechanism 34*c*. The cleaning blade 34*a* is a strip-shaped member which is mounted along the axial direction of the photoconductive drum 14, and formed of urethane rubber or the like, for example. The cleaning blade 34*a* is arranged in pressure contact with the photoconductive drum 14 in a direction opposite to the rotation direction of the photoconductive drum 14. The cleaning blade 34*a* is fixed to a housing of the cleaning device 34 by way of the bracket 34*b*. The toner recovering mechanism 34*c* includes an arm 34*e* which is arranged so as to rotate around an axis 34*d*, and a scraping member 34*f* which is attached to a free end of the arm 34*e*.

The sub toner replenishing unit 35 includes a first sub agitator 35*b* and a second sub agitator 35*c* provided in a sub toner containing room 35*a* which contains the toner. This sub toner replenishing unit 35 is connected to a main toner replenishing unit 60 by way of a connecting passage 66. The connecting passage 66 is disposed in a backward position of the process cartridge 30 in the drawing so as not to interfere with the optical path of the exposing beam from the exposing device 15.

The handle 36 will enhance operability of the user when the process cartridge 30 is mounted or exchanged, and at the same time, has a function of securing the process cartridge 30 at a determined position, through oscillating operation.

Then, the developing device 32 will be described in detail. The developing device 32 is contained in a housing 41 having an opening 42 at a position opposed to the photoconductive drum 14, and includes a developing unit 40 for developing with the toner the electrostatic latent image on the photoconductive drum 14, and the main toner replenishing unit 60 for replenishing the toner to the developing unit 40 which are integrally provided in a horizontal direction. The above described sub toner replenishing unit 35 also constitutes a part of the developing device 32, and will replenish the toner to the main toner replenishing unit 60, as will be described below. It is to be noted that this developing device 32 is of the two-component developing system in which developer containing toner and carrier is used.

In this exemplary embodiment, the developing unit 40 is positioned diagonally below the photoconductive drum 14, and the opening 42 formed in the housing 41 is directed upward.

The housing 41 includes a lower housing 41*a*, an upper housing 41*b* fitted to the lower housing 41*a*, and a sub housing 41*c* which is fitted to both the lower housing 41*a* and the upper housing 41*b* inside the lower and upper housings.

A toner replenishing room 64 is formed between the sub housing 41*c* and an upper face of the lower housing 41*a*. A partition wall 61*a* which is formed upright on the upper face is engaged with a lower face of the upper housing 41*b*, whereby an interior of the housing 41 is divided into the developing unit 40 (an agitation area 47) and the main toner replenishing unit 60 (a toner containing room 61).

Moreover, a developer room 70 is formed below a lower face of the upper housing 41*b* and adjacent to the partition wall 61*a* at a side of the developing unit 40. This developer room 70 is defined by two wall plates 41*d* which are suspended at a determined distance in the longitudinal direction and side plates 41*e* (See FIG. 7 which will be described below) at both ends in the lateral direction, and projected in a shape of rectangular frame. The developer room 70 is positioned above the agitation area 47 and opens downward (an opening 71). This developer room 70 in this exemplary embodiment corresponds to one of containers which contain material, and one of a first or second powdery material containing parts according to the invention. The opening 71 corresponds to a supply opening according to the invention.

The developing unit 40 includes a developing roll 43, a pair of augers (a supply auger 44 and an agitation auger 45), and a film thickness regulating member 50.

The developing roll 43 is attached to a position opposed to the opening 42 of the housing 41. The developing roll 43 includes a magnet roll 43*a* which is fixed inside, and a developing sleeve 43*b* which is rotatably fitted to an outer peripheral face of the magnet roll 43*a*. A determined developing bias is applied to the developing sleeve 43*b* from a power supply which is not shown. The developing sleeve 43*b* is driven to rotate by a drive mechanism which is not shown.

The supply auger 44 and the agitation auger 45 are disposed at a back side of the developing roll 43 in a lower part in the housing 41.

The back side of the developing roll 43 is divided into a supply area 46 and the agitation area 47 by a partition wall 48 which is uprightly formed on the lower housing 41*a*. It is to be noted that the partition wall 48 is not provided in determined regions near both ends in the lateral direction, and passage of the developer between the supply area 46 and the agitation area 47 is made possible in these regions. This supply area in this exemplary embodiment corresponds to a supply space according to the invention.

The supply auger 44 is disposed in the supply area 46 which is close to the developing roll 43, and the agitation auger 45 is disposed in the agitation area 47 which is close to the main toner replenishing unit 60, at an opposite side to the supply area 46 interposing the partition wall 48.

The film thickness regulating member 50 is provided in the housing 41, at a diagonally left side above the developing roll 43 in the drawing. This film thickness regulating member 50 has a certain gap with respect to the developing roll 43 along the axial direction of the developing roll 43. The film thickness regulating member 50 is formed as a shaft in a columnar shape and will regulate the developer maintained on the developing roll 43 to a determined thickness.

The main toner replenishing unit 60 includes the toner containing room 61 which is separated from the developing unit 40 by the partition wall 61*a* uprightly provided on the sub housing 41*c*, and the toner replenishing room 64 which is formed between the sub housing 41*c* and the lower housing 41*a*. A first agitator 62 and a second agitator 63 are provided inside the toner containing room 61. A replenishing auger 65 is provided in the toner replenishing room 64. This toner containing room 65 in this exemplary embodiment corresponds to one of the containers for containing material, and one of the first and the second powdery material containing parts according to the invention.

A toner inlet port 67 which connects the toner containing room 61 to the toner replenishing room 64 is formed in the sub housing 41*c* at a backward side in the drawing. Moreover, a toner replenishing port 68 which connects the toner replenishing room 64 to the agitation area 47 is formed in the sub housing 41*c* at a front side in the drawing. In this manner, the toner contained in the toner containing room 61 can be supplied to the developing unit 40 (the supply area 46) through the toner inlet port 67, the toner replenishing room 64, and the toner replenishing port 68. This toner replenishing port 68 in this exemplary embodiment corresponds to the supply opening according to the invention.

The developing device 32 having the above described structure functions as follows, on occasion of image forming operation.

In the developing unit 40, the supply auger 44 will convey the developer from the back side to the front side in the drawing in the supply area 46, and the agitation auger 45 will convey the developer from the front side to the back side of the drawing in the agitation area 47. Because the supply area 46 and the agitation area 47 are connected for communication at both ends in the longitudinal direction as described above, the developer will be circularly conveyed while it is agitated in the housing 41. On this occasion, the carrier has positive electrification polarity, while the toner has negative electrification polarity. Accordingly, the toner and the carrier in the developer will be rubbed against each other, and the carrier will be electrified to positive polarity, while the toner will be electrified to negative polarity.

When the agitated developer has been supplied to the supply area 46 which is opposed to the developing roll 43, the carrier in the developer will be magnetically sucked by magnetic attraction of a magnetic pole provided on the magnet roll 43*a*, and will be transferred to adhere to the developing sleeve 43*b*. On this occasion, the toner will be also transferred to adhere to the developing sleeve 43*b* following the carrier, because the toner which has been electrified to the negative polarity is electrostatically sucked to the carrier which has been electrified to the positive polarity. As the results, the developer containing the toner and the carrier will adhere to the developing sleeve 43*b*. Then, the developer on the developing sleeve 43*b* will be conveyed in a state held on the developing sleeve 43*b* by the rotation of the developing sleeve 43*b* and magnetic attraction of the magnet roll 43*a*, and regulated to a determined thickness by the film thickness regulating member 50, to be conveyed to the opening 42 which is opposed to the photoconductive drum 14.

A determined developing bias is applied to the developing sleeve 43*b* from a power supply which is not shown. Accordingly, in a developing area adjacent to the photoconductive drum 14, the toner will be transferred from a film of the developer on the developing sleeve 43*b* to the electrostatic latent image which is formed on the photoconductive drum 14 thereby to visualize the latent image into a visible image (a toner image).

The film of the developer on the developing sleeve 43*b* which has passed the opening 42 of the housing 41 and finished development will be removed by a repulsive magnetic field which is formed between magnetic poles having the same polarity on the magnet roll 43*a* and falls in the supply area 46. The developer which has fallen in the supply area 46 will be again agitated and conveyed by the supply auger 44 and the agitation auger 45, to be supplied for the next developing process.

In the developing unit 40, a ratio of the toner (density of the toner) in the developer will be gradually lowered, while the electrostatic latent images on the photoconductive drum 14 are developed into the visual images. For this reason, in this exemplary embodiment, fresh toner will be replenished from the main toner replenishing unit 60 to the developing unit 40 in which the toner density has been lowered.

In order to replenish the toner from the main toner replenishing unit 60 to the developing unit 40, the toner in the toner containing room 61 of the main toner replenishing unit 60 will be supplied to the toner replenishing room 64 through the toner inlet port 67, and the toner in the toner replenishing room 64 will be conveyed by the replenishing auger 65 to the agitation area 47 in the developing unit 40 through the toner replenishing port 68. The toner which has been replenished to the agitation area 47 in the developing unit 40 in this manner will be agitated together with the developer which is already present in the developing unit 40, by the agitation auger 45. The developer and the toner which has been newly supplied will be mixed by agitation, and will be conveyed from the agitation area 47 to the supply area 46 to be supplied for the developing process.

Moreover, when the toner contained in the toner containing room 61 has been supplied to the developing unit 40 and has decreased, the toner contained in the sub toner replenishing unit 35 will be replenished by way of the connecting passage 66.

In this manner, as the toner in the developing unit 40 is consumed, the toner will be replenished from the main toner replenishing unit 60 to the developing unit 40, and also from the sub toner replenishing unit 35 to the main toner replenishing unit 60. Accordingly, the density of the toner in the developer in the developing unit 40 can be maintained substantially constant, until the life of the process cartridge 30 expires.

In this exemplary embodiment, the process cartridge 30 is intended to be solely packed and transported, and will be mounted to the main body 10*a* of the image forming apparatus 10 by the user, for example.

In case where the process cartridge 30 is transported, the developer including the carrier and toner which have been mixed at a determined ratio, and the toner to be replenished are contained in the developing device 32, without anxiety of leak. The developer and the toner to be replenished in this exemplary embodiment correspond to the material, and the first or second powdery material according to the invention.

Then, structure for containing the developer and the toner during the transportation, and structure for enabling the developer and the toner to be supplied, when the process cartridge 30 is mounted to the main body 10*a* of the image forming apparatus 10, will be described referring to FIG. 4 and the following drawings.

Figure 5:
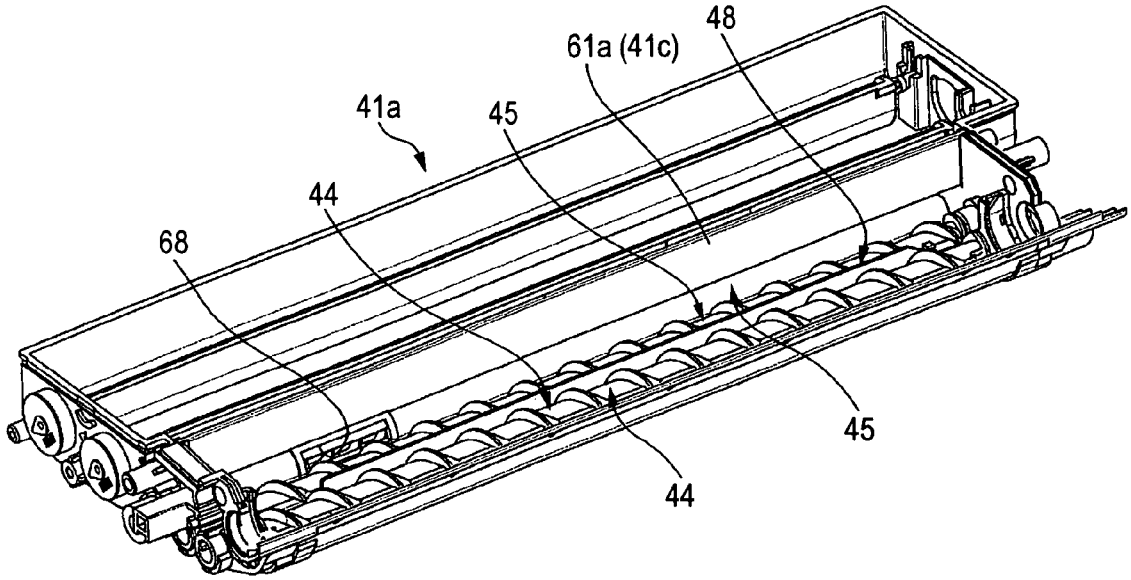
FIG. 5 is a perspective view of a lower housing.
Figure 6:
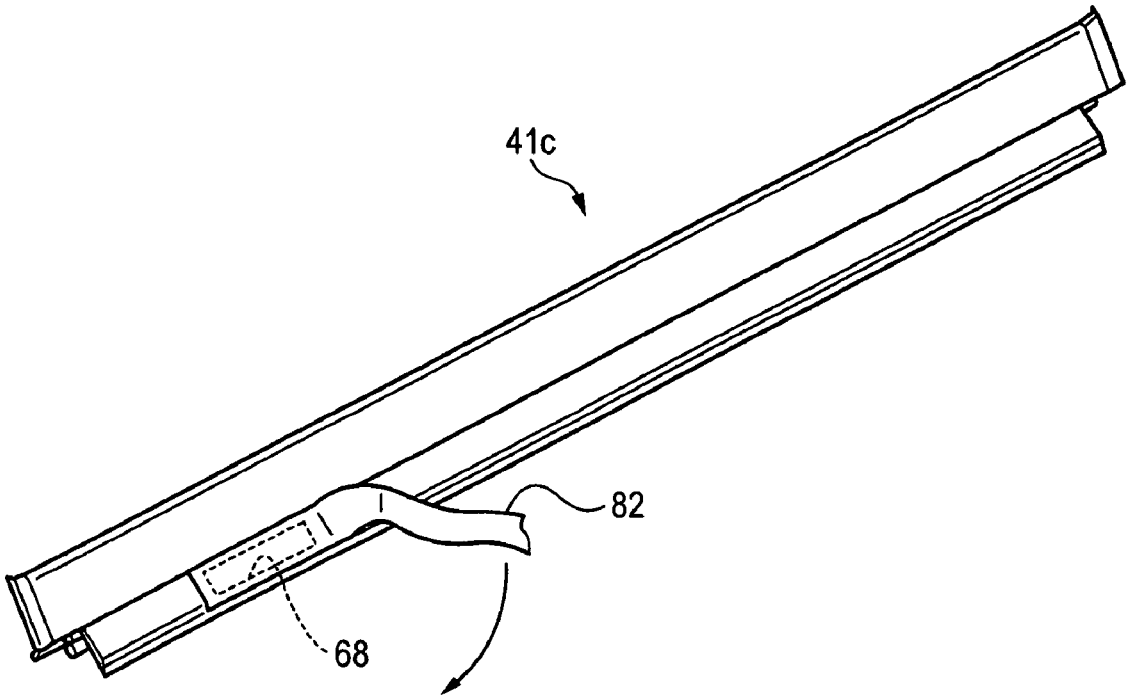
FIG. 6 is a perspective view of a sub housing as seen from a diagonally front side.
Figure 7:
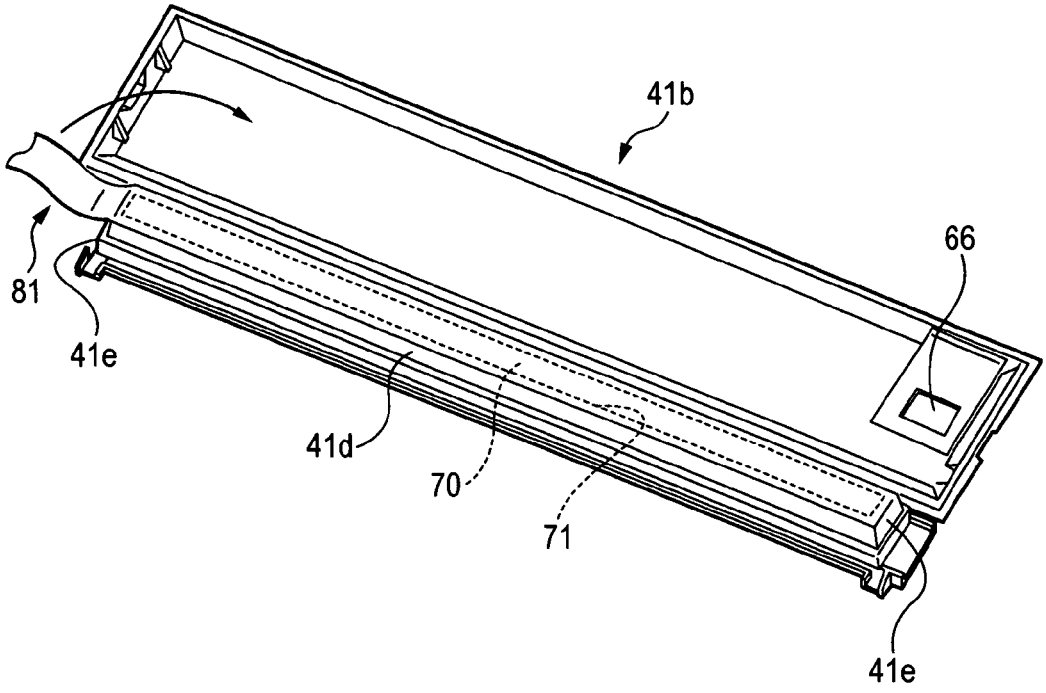
FIG. 7 is a perspective view of an upper housing in a state inverted upside down.
Figure 8:
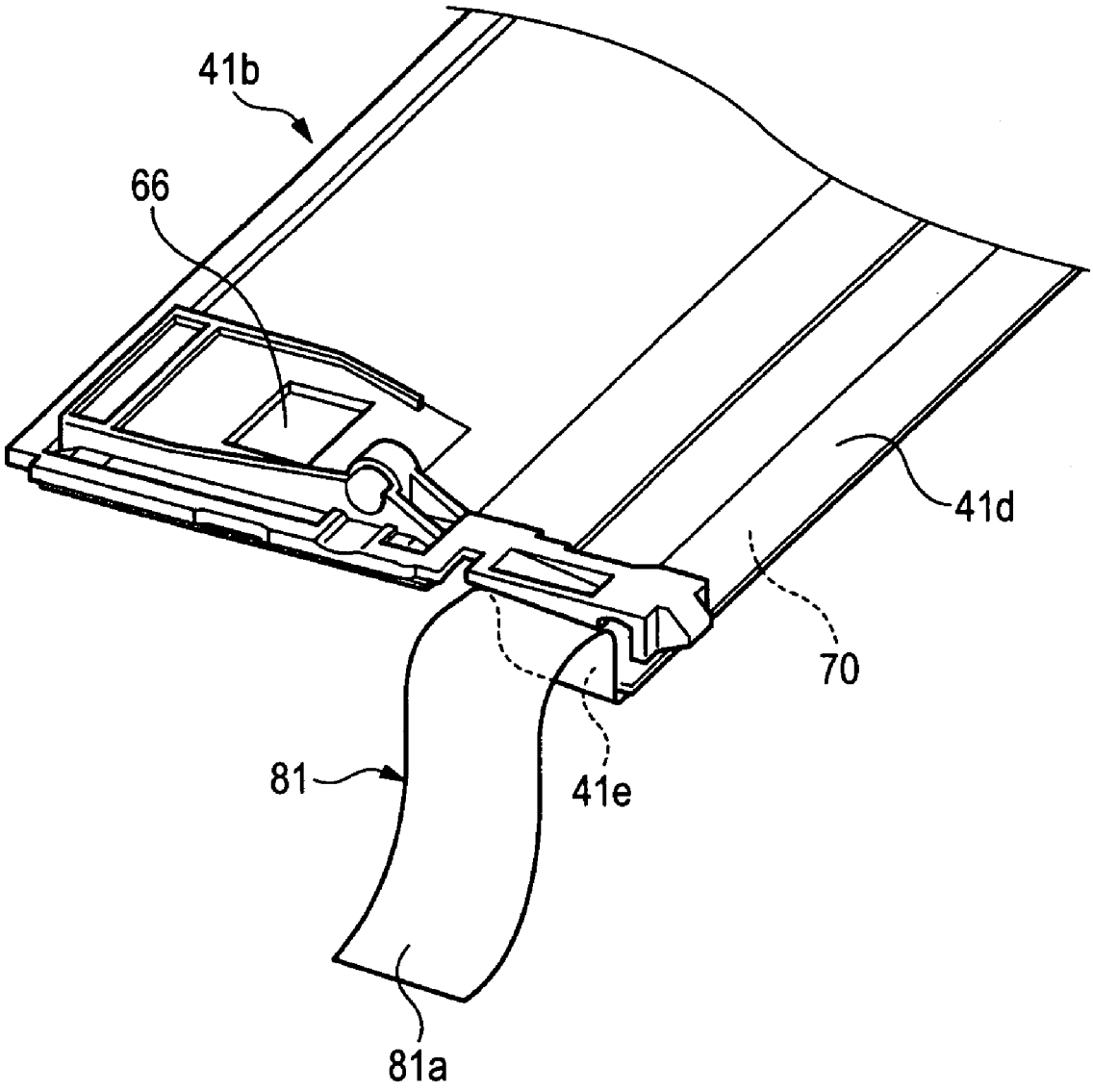
FIG. 8 is a perspective view of an end part of the upper housing.
Figure 9:
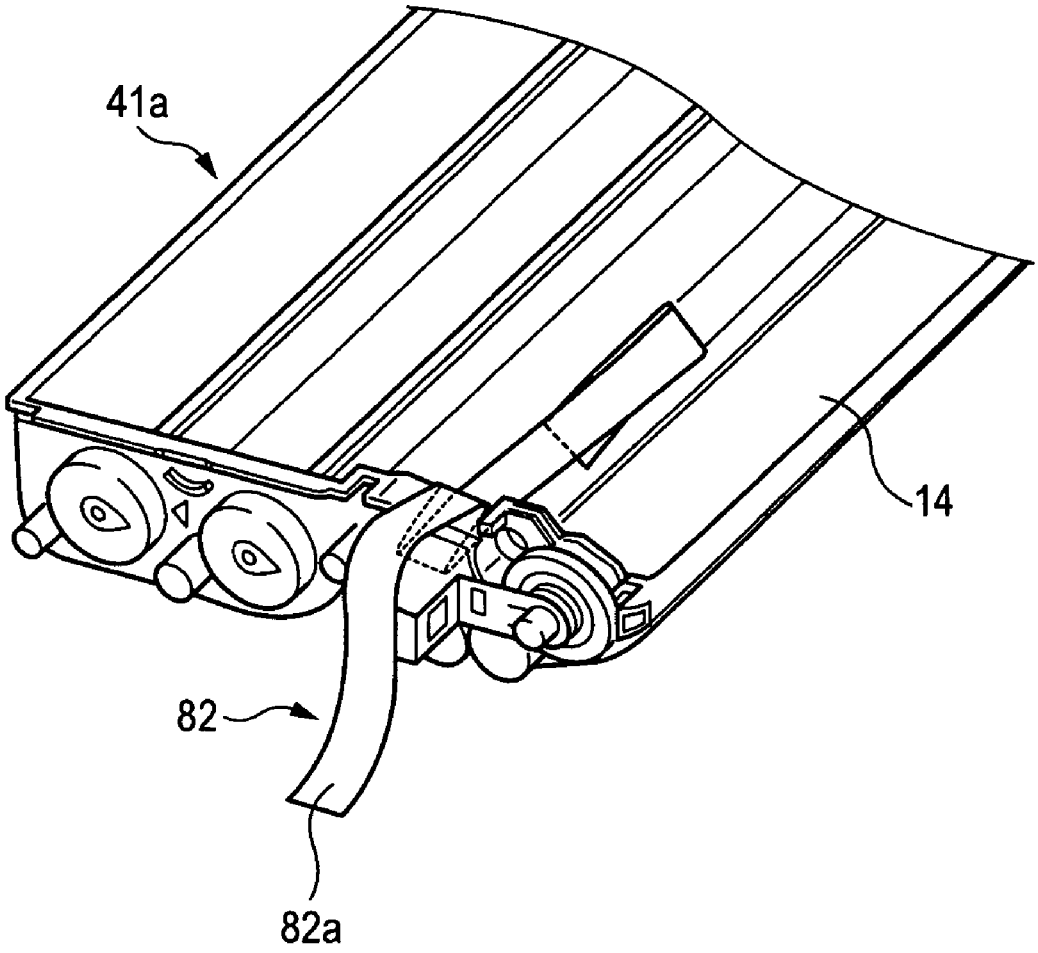
FIG. 9 is a perspective view of an end part of the lower housing.
Figure 10:
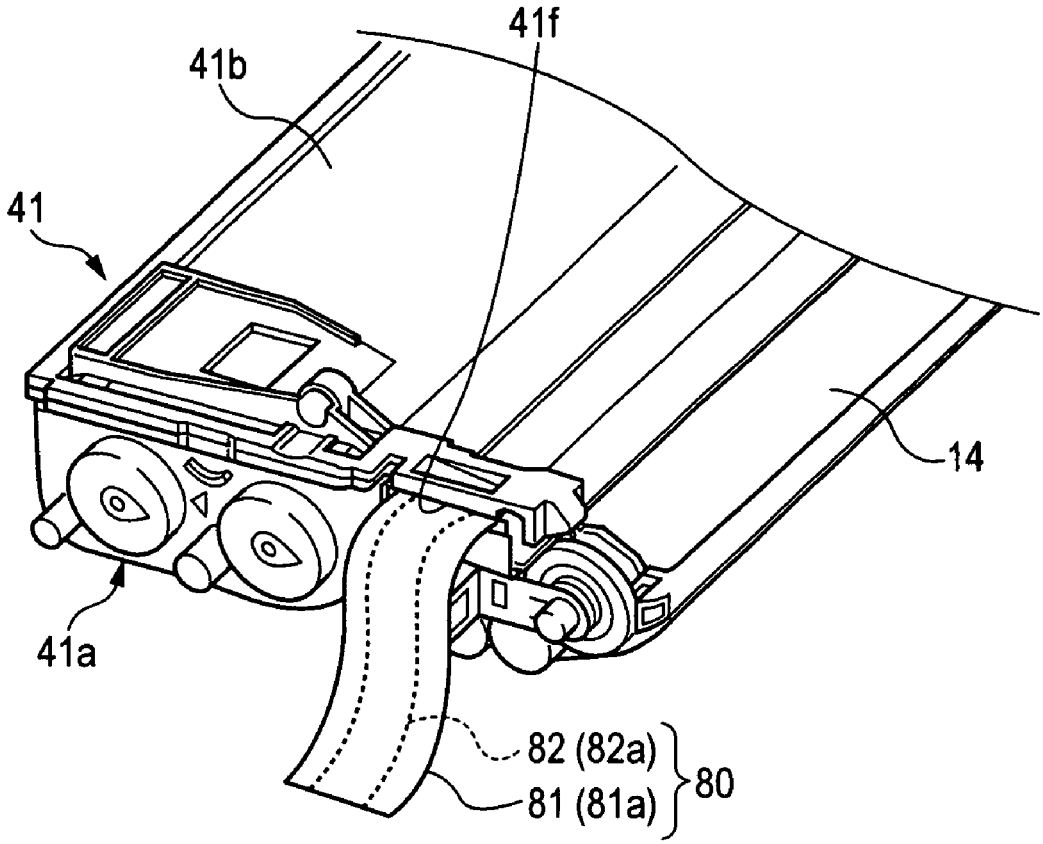
FIG. 10 is a perspective view of the end parts in a state where the upper housing has been assembled to the lower housing.

FIG. 5 is a perspective view of the lower housing 41*a*, FIG. 6 is a perspective view of the sub housing 41*c* as seen from a diagonally front side (from the developing unit 40), and FIG. 7 is a perspective view of the upper housing 41*b* inverted upside down. The lower housing 41*a*, the upper housing 41*b* and the sub housing 41*c* are integrally assembled to constitute the housing 41. FIGS. 5 to 7 are the drawings for explanation only, but do not show that the housing 41 can be actually disassembled in this manner. Further, FIG. 8 is a perspective view of an end part of the upper housing 41*b*, FIG. 9 is a perspective view of an end part of the lower housing 41*a*, and FIG. 10 is a perspective view of the end parts in a state where the upper housing 41*b* has been assembled to the lower housing 41*a*.

As described above, the developer room 70 which contains the developer is formed in a shape of a rectangular frame enclosed by the two wall plates 41*d* on the lower face of the upper housing 41*b* and two side plates 41*e* at both ends in the lateral direction, and positioned above the agitation area 47 to open at the opening 71 in the bottom. The developer is contained in this developer room 70, and the opening 71 is closed with a developer sealing tape 81 as a seal member, as shown in FIGS. 4 and 7.

Moreover, the main toner replenishing unit 60 and the sub toner replenishing unit 35 are filled with the toner, and the toner replenishing port 68 between the toner replenishing room 64 and the developing unit 40 (the agitation area 47) is closed with a toner sealing tape 82, as a seal member attached to a face of the sub housing 41*c* at a side of the developing unit 40, as shown in FIGS. 4 and 6.

In other words, in a state where the process cartridge 30 is supplied, the toner and the developer are not present in the agitation area 47 and the supply area 46 in the developing device 32, but both the areas are empty. By removing the developer sealing tape 81, the opening 71 will be opened and the developer room 70 will communicate with the supply area 46 through the agitation area 47, and by removing the toner sealing tape 82, the toner replenishing port 68 will be opened and the toner replenishing room 64 will communicate with the supply area 46 through the agitation area 47. As the results, the developer and the toner can be supplied to the supply area 46, for the first time.

In this exemplary embodiment, the opening 71 of the developer room 70 are slightly inclined from the horizontal direction toward the toner replenishing room 64. The toner replenishing port 68 is positioned diagonally below the opening 71 and slightly inclined upward. The opening 71 and the toner replenishing port 68 are arranged at an angle of approximately 90 degree.

Each of the developer sealing tape 81 and the toner sealing tape 82 is formed of a resin tape having a heat fusible layer on its one face. In a state where a bonding face (the face formed with the heat fusible layer) is in contact with the area to be bonded (the opening 71 or the toner replenishing port 68), by heating and pressurizing them with a hot plate from a front face (the face which is not provided with the heat fusible layer), the heat adhesive layer will be melted and bonded to the member to be bonded. An adhesion force is determined to such an extent that the developer or toner may not leak, and that the tape can be easily removed.

The developer sealing tape 81 which seals the opening 71 of the developer room 70 is attached to the wall plates 41*d* and the end faces of the side plates 41*e* which define the developer room 70 thereby to close the opening 71. The tape 81 has a length twice or more of a longitudinal length of the opening 71, and its tip end corresponds to one end of the opening 71. The tape 81 is folded back at the other end of the opening 71, and a free end thereof is extended outward from a side end of the upper housing 41*b*, as shown in FIG. 8. This free end forms an operating part 81*a*. The operating part 81*a* in this exemplary embodiment corresponds to a first or second operating part according to the invention.

On the other hand, the toner sealing tape 82 which seals the toner replenishing port 68 is attached to a circumferential edge of the toner replenishing port 68, as shown in FIG. 6, thereby to close the toner replenishing port 68. A tip end of the toner sealing tape 82 corresponds to one end of the toner replenishing port 68. The tape 82 is folded back at the other end of the toner replenishing port 68, and a free end thereof is extended outward from the lower housing 41*a*, as shown in FIG. 9. This free end forms an operating part 82*a*. The operating part 82*a* in this exemplary embodiment corresponds to one of the first or second operating part according to the invention.

In this exemplary embodiment, the developer sealing tape 81 and the toner sealing tape 82 are positioned close to each other, although at different angles, and the free end of both the tapes are substantially at the same position. Moreover, the bonding faces of both the tapes are opposed to each other at a certain angle. In a state where the developer sealing tape 81 is superposed on the toner sealing tape 82 with their bonding faces opposed to each other, the free ends 81*a* and 82*a* of both the tapes pass between the side plate 41*e* of the developer room 70 and an inner face of the side edge of the lower housing 41*a*, and are guided outward from a side end of the housing 41, through a slit 41*f* which is formed between the lower housing 41*a* and the upper housing 41*b*, as shown in FIG. 10.

The slit 41*f* is formed at a substantially same angle as the end face of the opening 71 of the developer room 70, whereby the developer sealing tape 81 will be guided out keeping its posture as it is. On the other hand, the toner sealing tape 82 for closing the toner replenishing port 68 which has a certain angle with respect to the opening 71 will be twisted in a passage defined by the side plate 41*e* of the developer room 70 and guided out in a state superposed under the developer sealing tape 81.

Because the developer sealing tape 81 and the toner sealing tape 82 are superposed and guided out through the slit 41*f* in a state where their bonding faces are opposed to each other, surfaces which are not the bonding faces will come into contact with the outside, thus enabling smooth sliding motion to be effected when the tapes are withdrawn.

It is apparent that respective widths of the developer sealing tape 81 and the toner sealing tape 82 should be set larger than widths of the objects to be closed (the opening 71 and the toner replenishing port 68). Apart from this factor, the developer sealing tape 81 positioned above is set to be larger in width by a determined amount than the toner sealing tape 82 positioned below.

Then, the developer sealing tape 81 and the toner sealing tape 82 are bonded to each other at their free ends (81*a*, 82*a*) which are extended outside of the housing 41, and integrated into one piece as a superposed tape part 80. The free ends may be heat welded, since the bonding faces (the heat fusible layers) are opposed to each other. Alternatively, a double-faced boding tape or bonding agent can be used. In this case, because the heat fusible layers are to be bonded to each other, they cannot be easily separated, and favorable bonding can be attained. These boding sections in this exemplary embodiment correspond to a connecting section and a pasting section according to the invention.

Moreover, because the developer sealing tape 81 positioned above is set to be larger in width than the toner sealing tape 82 positioned below, the toner sealing tape 82 pasted with the double-faced bonding tape, for example, may be pasted to the developer sealing tape 81. By doing so, even in case where the toner sealing tape 82 has been displaced when bonded to the developer sealing tape 81, side edges of the toner sealing tape 82 will be hidden behind the developer sealing tape 81, and ugly appearance will be avoided. Therefore, it would be unnecessary to pay delicate attention to the bonding work.

The superposed tape part 80 formed of the developer sealing tape 81 and the toner sealing tape 82 which have been guided out from the side end of the housing 41 and bonded to each other into one tape is attached to a side face of the process cartridge 30 by means of a holding member 90. A cover 37 for covering projecting members such as bearings so as to form a flat side face is mounted on the side face of the housing 41. The holding member 90 is engaged with an outer face of this cover 37 to be fixed thereto.

Figure 11:
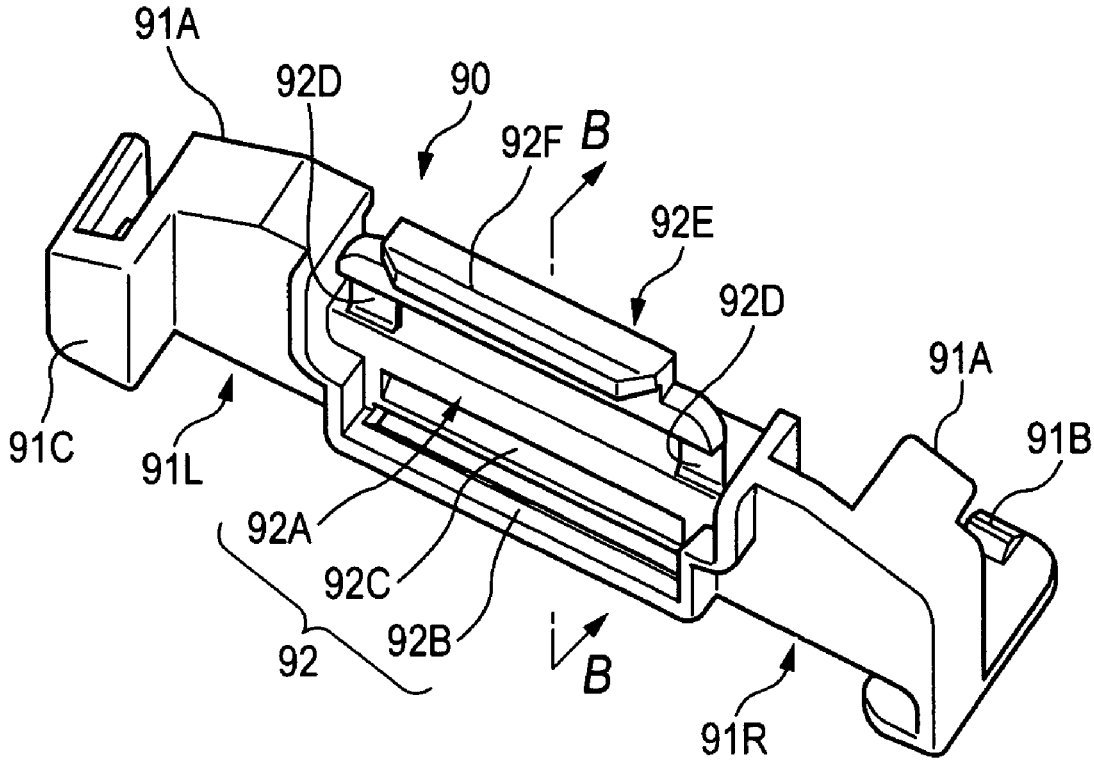
FIG. 11 is a perspective view of an outer appearance of a holding member in a state not locked to sealing tapes.
Figure 12A:
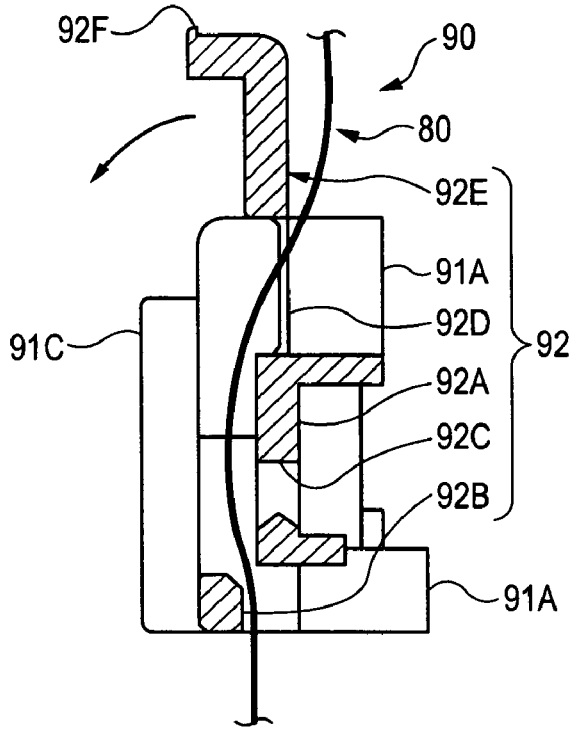
FIGS. 12A and 12B are sectional views showing operation of the holding member.
Figure 12B:
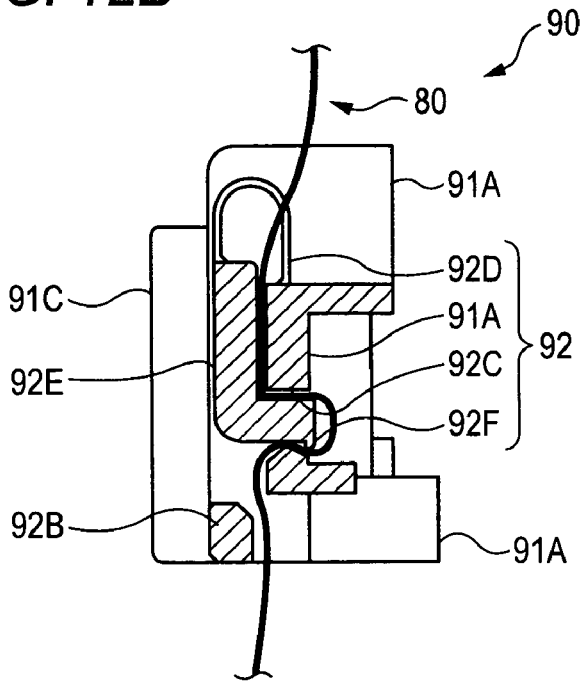

FIG. 11 is a perspective view of an outer appearance of the holding member 90 in a free state. FIGS. 12A and 12B are sectional views showing operation of the holding member 90, in which FIG. 12A is a sectional view taken along a line B-B in FIG. 11, and FIG. 12B is a sectional view taken along the same line showing the holding member 90 and the superposed tape part 80 in a locked state.

The holding member 90 is a molded product of synthetic resin, and provided with a tape locking part 92 between left and right securing parts 91L and 91R at both ends thereof.

The tape locking part 92 includes a support plate 92A which is provided so as to bridge the left and right securing parts 91L and 91R, and a guide bar 92B.

The support plate 92A is in a shape of flat plate having a plate surface in a vertical direction in the drawings, and provided with a lock slit 92C which opens substantially all over the support plate 92A in the lateral direction. An inner face of the lock slit 92C at a lower side is formed in an angle shape.

Besides, a lock part 92E is formed at an upper end of the support plate 92A via flexible parts 92D. A lock ridge 92F is projected from a tip end of the lock part 92E. By elastically bending the flexible parts 92D, as shown by an arrow mark in FIG. 12A, the lock part 92E will be inserted into the lock slit 92C so that the lock ridge 92F at the tip end may be engaged with the angle shaped inner face of the lock slit 92C. The flexible parts 92D each having a determined width are provided only at both ends of the support plate 92A, in such a manner that the superposed tape part 80 can pass between the support plate 92A and the lock part 92E.

The guide bar 92B is provided diagonally below the support plate 92A leaving such a gap that the superposed tape part 80 can pass through.

In the tape locking part 92 having the above described structure, the superposed tape part 80 will be inserted between the support plate 92A and the lock part 92E from a right side to a left side in the drawing, and further, passed downward from a front side (a left side in the drawing) of the support plate 92A through the gap between the support plate 92A and the guide bar 92B, as shown in FIG. 12A. Thereafter, by bending the flexible parts 92D, the lock part 92E is engaged with the lock slit 92C, whereby the lock part 92E will bite the superposed tape part 80 to lock it into the lock slit 92C, as shown in FIG. 12B. In this manner, the holding member 90 is fixed to the superposed tape part 80. This lock between the holding member 90 and the superposed tape part 80 is such that when a distal end of the superposed tape part 80 is pulled with a force while the holding member 90 is held, the lock part 92E will be pushed out from the lock slit 92C by the superposed tape part 80, whereby the lock can be released.

Each of the left and right securing parts 91L and 91R is provided with a butting part 91A to be butted against the side face of the cover 37, and a lock securing part 91B to be locked into a lock hole which is formed in the cover 37. Moreover, one of the securing parts 91L has an interference projection 91C which is projected outward at a determined height.

The holding member 90 having the above described structure, is attached to the superposed tape part 80 by means of the tape locking part 92, and fixed by engagement to the cover 37 of the process cartridge 30. Accordingly, the superposed tape part 80 can be held neatly along the side face of the process cartridge 30, as shown in FIG. 3. On this occasion, the distal end of the superposed tape part 80 is projected downward from the holding member 90 by a determined length, as shown in FIG. 3. Engaging strength of the holding member 90 with respect to the cover 37 is set to be at such extent that the engagement can be easily released.

According to the above described structure, by pulling the distal end of the superposed tape part 80 projecting downward from the holding member 90 in a direction away from the process cartridge 30, the holding member 90 will be detached from the cover 37 (the process cartridge 30). Thereafter, by removing the two sealing tapes 81 and 82 at the same time, the opening of the developer room 70 and the toner replenishing port 68 can be opened simultaneously. In short, it is possible to easily and simply open both the opening of the developer room 70 and the toner replenishing port 68 by only one removing operation.

Moreover, while the holding member 90 is mounted to the process cartridge 30 (the cover 37), the holding member 90 is fixed in a state projected from the side face of the process cartridge 30. In this exemplary embodiment, as shown by a phantom line in FIG. 3, a width of the main body 10*a* of the image forming apparatus 10 at a position where the process cartridge 30 is to be installed (an installation opening 10*b*) is set to be such a size that only the process cartridge 30 can be inserted. Accordingly, the process cartridge 30 in a state provided with the holding member 90 cannot be installed into the main body 10*a*, because the holding member 90 interferes with a circumferential edge of the installation opening 10*b* which is hatched in FIG. 3. In other words, unless the holding member is detached and the superposed tape part 80 (the sealing tapes 81 and 82) is removed, the process cartridge 30 will be unable to be installed in the main body 10*a*. In this manner, the process cartridge 30 cannot be installed in case where the sealing tapes 81, 82 are forgotten to be removed, and a trouble resulting from the forgotten sealing tapes 81, 82 will be prevented beforehand.

It is to be noted that the invention is not limited to the above described exemplary embodiment, but can be appropriately modified. For example, although in this exemplary embodiment, the developer sealing tape 81 and the toner sealing tape 82 are bonded to each other at their free ends outside the housing 41 to be formed into the superposed tape part 80, they need not be bonded, but can be formed into one by the holding member 90. In short, the holding member 90 may be used also as the connecting section.

Moreover, also the image forming apparatus to which the invention is applied is not limited to the structure as described in the exemplary embodiment.

What is claimed is:

1. A material supplying container comprising:

a first housing;

a second housing fitted to said first housing;

a plurality of containers each of which contains a material;

a plurality of supply openings respectively formed correspondingly to said plurality of containers; and a plurality of seal members that respectively close said supply openings, said seal members being folded back at one end of said supply openings, each of said seal members including a sealing face, said supply openings being closed by the sealing faces, a connecting section that connects said plurality of seal members, wherein said plurality of seal members are guided outward through a space which is formed between said first housing and said second housing while said sealing faces face and overlap each other, said plurality of supply openings can be opened by simultaneously operating said plurality of seal members, wherein the respective supply openings of said plurality of containers are at an angle with respect to each other, and at least one of said plurality of seal members is twisted when it is connected to the other seal member by the connecting section.

2. A material supplying container as claimed in claim 1, wherein the said plurality of seal members are so set as to have different widths from each other.

3. A material supplying container as claimed in claim 1, wherein the respective supply openings of said plurality of containers are at an angle with respect to each other, and at least one of said plurality of seal members is twisted when it is connected to the other seal member by the connecting section.

4. The material supplying container according to claim 1, wherein said plurality of seals are configured to be drawn from one slit formed in the space.

5. An image forming unit which is so constructed as to be detachably mounted on a main body of an image forming apparatus, the image forming unit comprising:

an image holding body on which an electrostatic latent image is formed;

a developing device that forms a visual image of the electrostatic latent image by employing a developer including a first powdery material and a second powdery material; and a developer containing section that mixes the first powdery material and the second powdery material in a supply space and supplies the first and second powdery materials to the developing device, wherein the developer containing section comprises:

a first housing;

a second housing fitted to said first housing;

a first powdery material containing part that contains the first powdery material and has a first supply opening which opens toward the supply space;

a first seal member that closes the first supply opening and is folded back at one end of the first supply opening, said first seal member including a first sealing face, the first supply opening being closed by the first sealing face;

a second powdery material containing part that contains the second powdery material and has a second supply opening which opens toward the supply space;

a second seal member that closes the second supply opening and is folded back at one end of the second supply opening, said second seal member including a second sealing face, the second supply opening being closed by the second sealing face, and a connecting section that connects said first and second seal members, wherein the first supply opening and the second supply opening are constructed as to be opened by simultaneously operating the first seal member and the second seal member, said first seal member and said second seal member being guided outward through a space which is formed between said first housing and said second housing while said first sealing face and said second sealing face face and overlap each other, and wherein the first and second supply openings are at an angle with respect to each other, and at least one of said plurality of seal members is twisted when it is connected to the other seal member by the connecting section.

6. An image forming unit as claimed in claim 5, further comprising a holding member which secures the first seal member and the second seal member to an outer face of the image forming unit.

7. An image forming unit as claimed in claim 6, wherein the holding member juts out from the image forming unit so as to prevent the image forming unit from being mounted to the main body.

8. The image forming unit according to claim 5, wherein said plurality of seals are configured to be drawn from one slit formed in the space.

* * * * *